US006681965B1

(12) United States Patent
Tran

(10) Patent No.: US 6,681,965 B1
(45) Date of Patent: Jan. 27, 2004

(54) DECORATIVE WIRE RIBBON BOW

(76) Inventor: Tuyen Thi Tran, 6434 Bayhill Dr., Abilene, TX (US) 79606

( * ) Notice: Subject to any disclaimer, the term of this patent is extended or adjusted under 35 U.S.C. 154(b) by 0 days.

(21) Appl. No.: 10/098,898

(22) Filed: Mar. 13, 2002

(51) Int. Cl.[7] ..... A41H 43/00
(52) U.S. Cl. ..... 223/46
(58) Field of Search ..... 223/46; 428/4, 428/5

(56) References Cited

U.S. PATENT DOCUMENTS 2,886,912 A * 5/1959 Rowland ..... 428/5
5,614,274 A * 3/1997 Huss ..... 428/5
5,800,881 A * 9/1998 Etzion ..... 428/5

* cited by examiner

*Primary Examiner*—John J. Calvert
*Assistant Examiner*—James G Smith
(74) *Attorney, Agent, or Firm*—Michael I. Kroll

(57) ABSTRACT

The present invention 10 discloses a method of forming a decorative artificial bow using wire border ribbon 22 in strip form either in rolls or otherwise whereby the user may cut the ribbon in lengths according to the bow size required. The length of wire border ribbon 22 is laid out so as to form four loop members 16 on each respective side having opposing distal ends and joined together at the center. The loop members 16 are secured by means of a metal wire retainer 24 securing the center of the folded ribbon, forming the bow. Using a scissor, both distal ends of the ribbon are cut to form a "V" shaped end 26 and the second set of loop members from the bottom portion of the ribbon are also cut to form "V" shaped ends 28. The loop members are rearranged to create a pleasing flower-like design. Using a glue gun 32, a self-adhering tag 36 is fixedly attached to the bottom portion of the bow. The self-adhering portion of the tag has a peel-off protective sheet of paper 40 that is removed when the bow is to be used. With the use of a glue gun, a decorative item 38 or items are glued in place on the top portion of the formed ribbon bow.

7 Claims, 12 Drawing Sheets

DECORATIVE WIRE RIBBON BOW

BACKGROUND OF THE INVENTION

1. Field of the Invention

The present invention relates generally to decorative artificial bows and, more specifically, to a method of forming a decorative artificial bow using wire border ribbon in strip form either in rolls or otherwise where by the user may cut the ribbon in lengths according to the bow size required.

The length of wire border ribbon is laid out so to form four loop members on each respective side having opposing distal ends and joined together at the center. The loop members are secured by means of a metal wire retainer, securing the center of the folded ribbon, forming the bow. Using a scissor, both distal ends of the ribbon are cut to form a "V" shaped end and the second set of loop members from the bottom portion of the ribbon are also cut to form "V" shaped ends. The loop members are rearranged to create a pleasing flower like design.

Using a glue gun, a self adhering tag is fixedly attached to the bottom portion of the bow. The self adhering portion of the tag has a peal of protective sheet of paper that is removed when the bow is to be used. With the use of a glue gun, a decorative item or items are glued in place on the top portion of the formed ribbon bow. The decorative design items can consist of a variety of objects to reflect seasonal, holiday or any relevant occasion. In accomplishing the above objectives according to the preferred embodiment of the present invention the device can be used in a variety of ways including the finishing of a gift package.

2. Description of the Prior Art

There are other artificial decorative bow devices designed for decorating packages. Typical of these is U.S. Pat. No. 440,876 issued to Finkelstein on Nov. 18, 1890.

Another patent was issued to Stark on Jan. 4, 1938 as U.S. Pat. No. 2,104,248. Yet another U.S. Pat. No. 2,584,254 was issued to Brodbeck on Feb. 5, 1952 and still yet another was issued on Sep. 17, 1958 to James as U.S. Pat. No. 2,806,313.

Another patent was issued to Crawford on Aug. 5, 1958 as U.S. Pat. No. 2,845,736. Yet another U.S. Pat. No. 2,886,912 was issued to Rowland on May 19, 1959. Another was issued to et al on Jun. 14, 1966 as U.S. Pat. No. 3,256,129 and still yet another was issued on May 4, 1976 to Bolis as U.S. Pat. No. 3,954,212.

Another patent was issued to LaBrosse et al. on Feb. 9, 1988 as U.S. Pat. No. 4,724,175. Yet another U.S. Pat. No. 5,198,274 was issued to Etzion on Mar. 30, 1993. Another was issued to Huss on Mar. 25, 1997 as U.S. Pat. No. 5,614,274 and still yet another was issued on Sep. 1, 1998 to Etzion as U.S. Pat. No. 5,800,881.

U.S. Pat. No. 440,876

Inventor: Shye Finkelstein

Issued: Nov. 18, 1890

The invention relates to the manufacture of silk faced trimming material and has for its object to produce fine flat faced silk covered strips which, while perfectly pliable, so as to be readily bent into any desired forms, shall nevertheless be sufficiently firm and tough as not to crack in bending.

U.S. Pat. No. 2,104,248

Inventor: Joseph W. Stark

Issued: Jan. 4, 1938

The present invention relates to ornamentation, and more particularly, to ornamental bows, rosettes and the like, formed from strips of ribbon produced from a nonfibrous cellulose sheet material.

U.S. Pat. No. 2,584,254

Inventor: Caroline Brodbeck

Issued: Feb. 5, 1952

The present invention relates to ornamental bows or rosettes, and particularly to articles of this nature which can be preformed and arranged for simplified attachment to any package or article to be ornamented by merely adhering the bow to the article in the desired location.

U.S. Pat. No. 2,806,313

Inventor: Bill Y. James

Issued: Sep. 17, 1957

This invention relates to gift wrappings for packages and particularly to decorative bows provided for added attractiveness, the primary object being to enhance the beauty of the bow itself regardless of the form which it may take by the provision of a decorative center therefor made and formed so as to conveniently utilize parts of the bow itself for holding the centerpiece in place.

U.S. Pat. No. 2,845,736

Inventor: Fred C. Crawford

Issued: Aug. 5, 1958

The invention relates to decorative bows or pompons for gift wrapping packages that when moistened will adhere to itself and the method of forming said pompons.

U.S. Pat. No. Des. 2,886,912

Inventor: Homer C. Rowland

Issued: May 19, 1959

This invention relates to decorative pompons bows for gift wrapping packages that when moistened will adhere to itself and the method of forming said pompons.

U.S. Pat. No. 3,256,129

Inventor: Lawrence et al

Issued: Jun. 14, 1966

The present invention relates to a ribbon material, and it particularly relates to a form holding ribbon construction.

U.S. Pat. No. 3,954,212

Inventor: Ernesto Bolis

Issued: May 4, 1976

A method for making ribbons curlable in a cockade, comprising the steps of longitudinally superimposing to a base ribbon a tape, causing the ribbon to pass along with the tape in a shearing unit for laterally shearing on the two sides of the ribbon two roundish cuts or notches and inserting on the ribbon and tape superimposed thereto a metal ring at the center of the sheared area.

U.S. Pat. No. 4,724,175

Inventor: Paul R. LaBrosse et al.

Issued: Feb. 9, 1988

A prefabricated bow form comprising sets of loop forming portions that are oriented relative to each other by generally triangular portions of the bow form when the bow is formed. The bow form can be configured to form bows that have the shape of Pom bows or shapes similar to Pom bows.

U.S. Pat. No. 5,198,274

Inventor: Rafael Etzion

Issued: Mar. 30,1993

A tie assembly for use in joining ornament elements to form an ornament. The tie assembly comprises a strip of material whose first and second ends have been folded over and placed in abutting dove-tail relationship. A tie element is joined to and along the length of the first and second ends of the folded strip and has third and fourth ends which extend beyond this length and can be used to fix the tie assembly and the ornament elements together.

U.S. Pat. No. 5,614,274

Inventor: Charles P. Huss

Issued: Mar. 25, 1997

A preformed self-adhering bow having a preformed bow member and at least one application band attached to the bow member. The at least one application band includes a layer of a pressure sensitive adhesive for adhering the bow to an object.

U.S. Pat. No. 5,800,881

Inventor: Rafael Etzion

Issued: Sep. 1, 1998

A decorative bow is formed of six discrete pieces of ribbon, including a first piece formed into a loop, second and third pieces each formed into a respective bow loop and gathered, a fourth piece of ribbon gathered but not formed into a loop, and fifth and sixth pieces both respectively gathered and folded to form angled drape members. A fastener inserted through the loop formed by the first piece of ribbon is twisted to secure together all six pieces of ribbon. A mounting rod secured to the decorative bow includes attachment tabs at respective ends of the mounting rod.

While these decorative bows may be suitable for the purposes for which they were designed, they would not be as suitable for the purposes of the present invention, as hereinafter described.

A method of forming a decorative artificial bow using wire border ribbon in strip form either in rolls or otherwise where by the user may cut the ribbon in lengths according to the bow size required. Said length of wire border ribbon is laid out so to form four loop members and opposing distal ends on each respective side and joined together at the center. The loop members are secured by means of a metal wire retainer, securing the center of the folded ribbon, forming the bow.

Using a scissor, both distal ends of the ribbon are cut to form a "V" shaped end and the second set of loop members from the bottom are cut and the end are cut to form "V" shaped ends.

The loop members are rearranged so to create a pleasing flower like design.

Using a glue gun, a tag is fixedly attached to the bottom portion of the bow. The tag has a self adhering portion covered by a protective sheet that is removed when the bow is to be used.

Additionally, a decorative item or items can be attached using the glue gun to the top portion of the formed ribbon bow. The decorative design items can consist of a variety of objects to reflect seasonal, holiday or any relevant occasion.

In accomplishing the above objectives according to the preferred embodiment of the present invention the device can be used in a variety of ways including the finishing of a gift package.

SUMMARY OF THE PRESENT INVENTION

The present invention discloses a method of forming a decorative artificial bow using wire border ribbon in strip form either in rolls or otherwise whereby the user may cut the ribbon in lengths according to the bow size required. The length of wire border ribbon is laid out so as to form four loop members on each respective side having opposing distal ends and joined together at the center. The loop members are secured by means of a metal wire retainer securing the center of the folded ribbon, forming the bow. Using a scissor, both distal ends of the ribbon are cut to form a "V" shaped end and the second set of loop members from the bottom portion of the ribbon are also cut to form "V" shaped ends. The loop members are rearranged to create a pleasing flower-like design. Using a glue gun, a self-adhering tag is fixedly attached to the bottom portion of the bow. The self-adhering portion of the tag has a peel-off protective sheet of paper that is removed when the bow is to be used. With the use of a glue gun, a decorative item or items are glued in place on the top portion of the formed ribbon bow.

A primary object of the present invention is to provide a method of forming a decorative artificial bow using wire border ribbon in strip form either in rolls or otherwise where by the user may cut the ribbon in lengths according to the bow size required.

Another object of the present invention is to provide Said length of wire border ribbon is laid out so to form four loop members on each respective side and joined together at the center.

Yet another object of the present invention is to provide loop members that are secured by means of a metal wire retainer, securing the center of the folded ribbon, forming the bow.

Still yet another object of the present invention is to provide bow that using a scissor, both distal ends of the ribbon are cut to form a "V" shaped end and the second set of loop members from the bottom portion of the ribbon are also cut to form "V" shaped ends.

Another object of the present invention is to provide a bow that the loop members are rearranged so to create a pleasing flower like design.

Yet another object of the present invention is to provide a bow that by using a glue gun, a self adhering tag is fixedly attached to the bottom portion of the bow. The self adhering portion of the tag has a peal of protective sheet of paper that is removed when the bow is to be used.

Still yet another object of the present invention is to provide a bow that with the use of a glue gun, a decorative item or items are glued in place on the top portion of the formed ribbon bow. The decorative design items can consist of a variety of objects to reflect seasonal, holiday or any relevant occasion.

Additional objects of the present invention will appear as the description proceeds.

The present invention overcomes the shortcomings of the prior art by providing a method of forming a decorative artificial bow using wire border ribbon in strip form whereby the user may cut the ribbon in lengths according to the bow size required. Said length of wire border ribbon is laid out to form four loop members and opposing distal ends on each respective side and a fastener attached at the center to hold the positioning. The loop members are secured by means of a metal wire retainer, securing the center of the folded ribbon, forming the bow.

Using a scissor, both distal ends of the ribbon are cut to form a "V" shaped end and the second set of loop members from the bottom of the ribbon are also cut wit the end also cut to form "V" shaped ends. The loop members are rearranged so to create a pleasing flower like design.

Using a glue gun, a self adhering tag is fixedly attached to the bottom portion of the bow. The self adhering portion of the tag has a peal of protective sheet of paper that is removed when the bow is to be used. With the use of the glue gun, a decorative item or items can be glued in place on the top portion of the formed ribbon bow.

The decorative design items can consist of a variety of objects to reflect seasonal, holiday or any relevant occasion. In accomplishing the above objectives according to the preferred embodiment of the present invention the device can be used in a variety of ways including the finishing of a gift package.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

Figure 1:
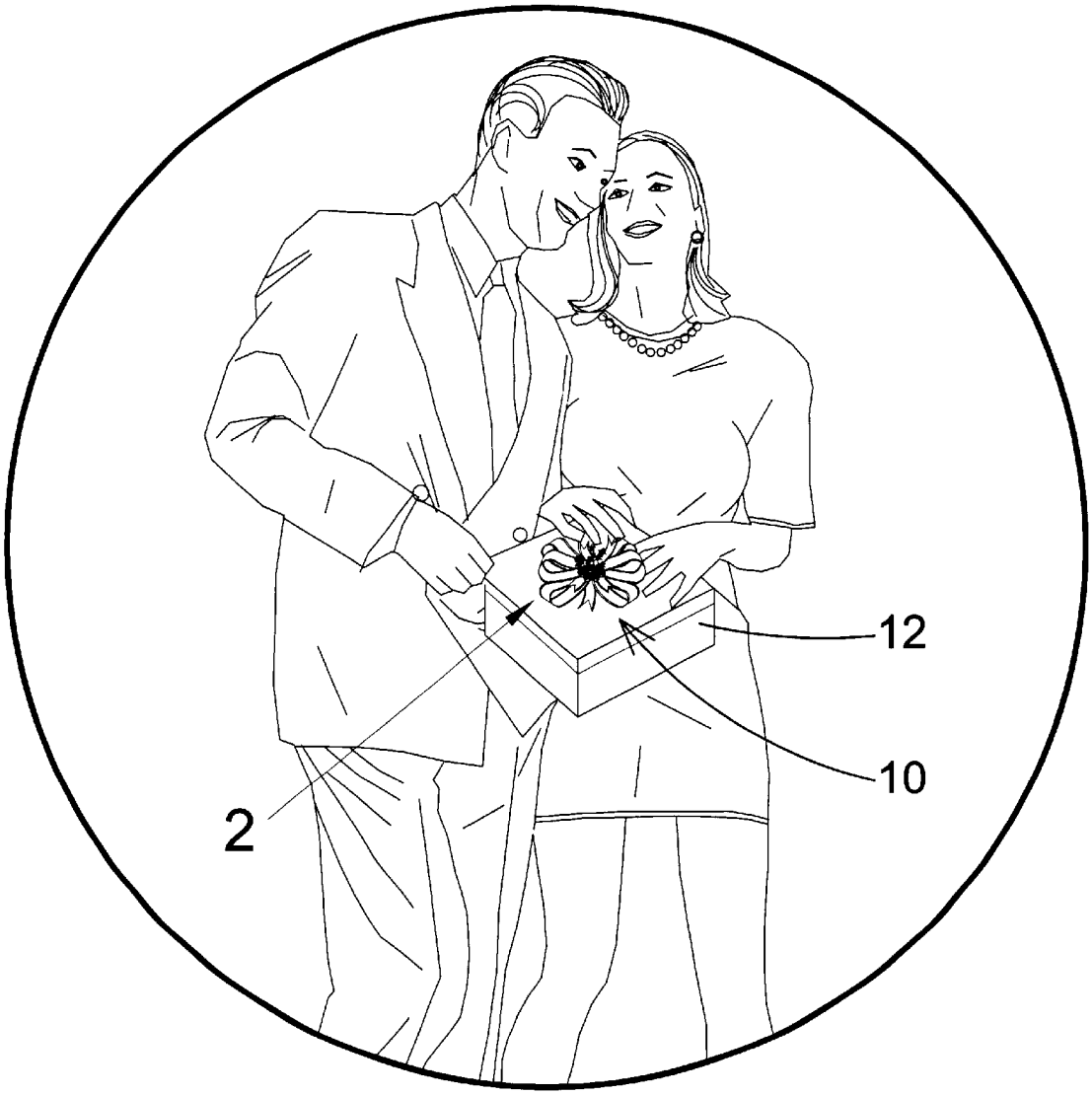
FIG. 1 is an illustrative view of the present invention in use.

LIST OF REFERENCE NUMERALS regard to reference numerals used, the following numbering is used throughout the drawings.

10 present invention
12 package
14 single piece of ribbon
16 four formed loop members
18 end piece
20 ribbon
22 wire border ribbon
24 wire retainer
26 V-shaped end
28 second loop member from bottom
30 flower-like design
32 glue gun
34 glue
36 self-adhesive tag
38 decorative item
40 protective layer
42 adhesive layer

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a decorative bow having wire ribbons on its outer borders, wire retainers, self-adhesive backing tag and finished with a decorative item or items. The device 10 can be used in a variety of ways including the finishing of a gift package 12. The method and steps to creating the preformed bow are explained hereinafter.

Figure 2:
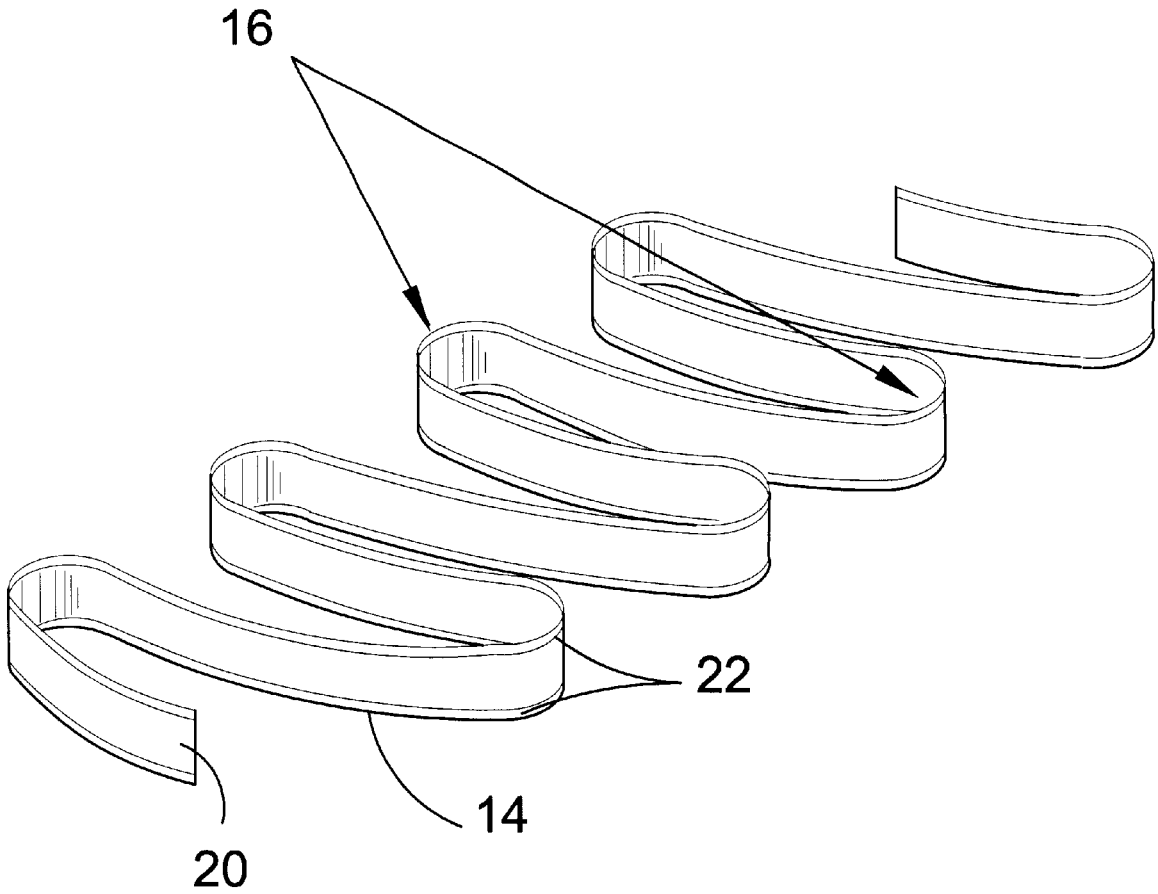
FIG. 2 is step one, a perspective view of the present invention.

Turning to FIG. 2, shown therein is step one, a perspective view of the present invention. In step one of the method of creating the bow of the present invention, a single length of ribbon 14, depending on the size of the bow that is to be assembled, is cut and laid out so the ribbon 14 forms four loop members 16 on each respective or opposing sides of the ribbon as shown. The ribbon 20 comprises wire border ribbon 22.

Figure 3:
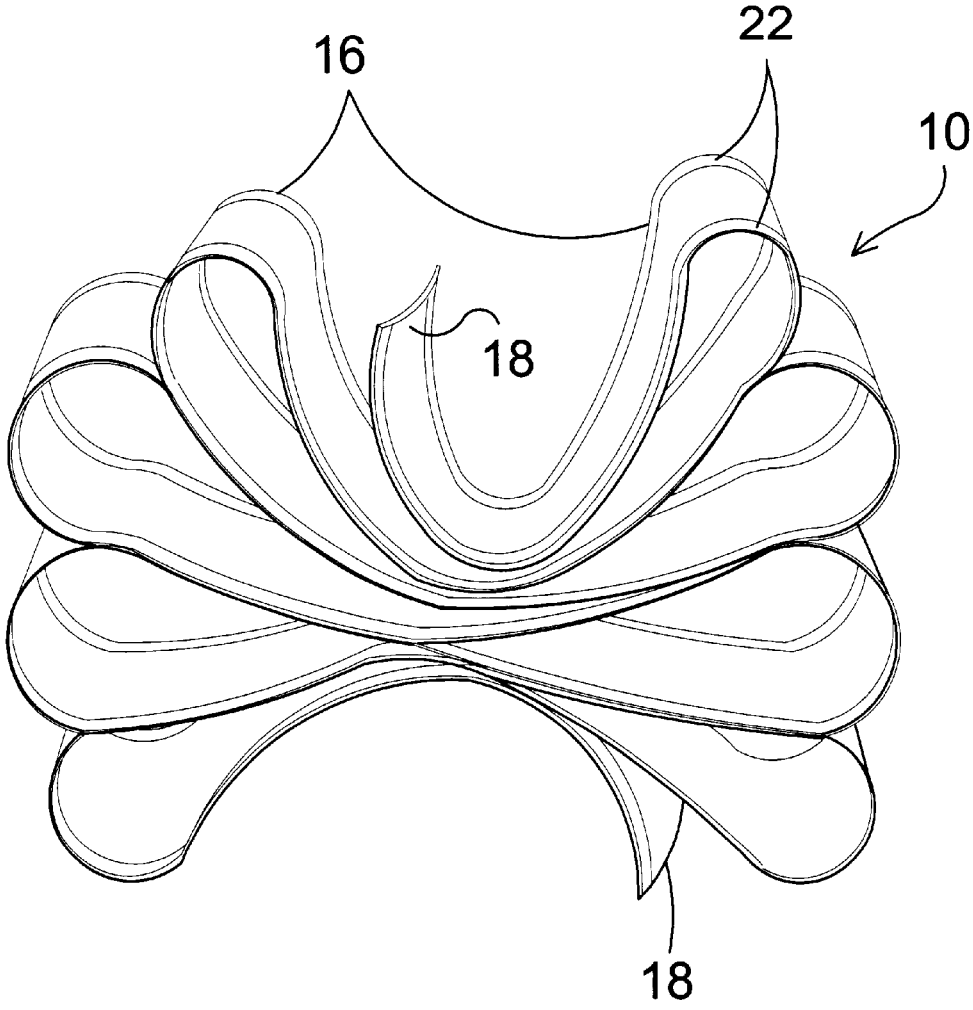
FIG. 3 is step two, a perspective view of the present invention.

Turning to FIG. 3, shown therein is step two, a perspective view of the present invention 10. In step two of the method of creating the bow of the present invention, a single length of wire border ribbon 22 is cut and laid out so the ribbon forms four loop members 16 on each respective side and joined together at the center to form a center fold. Also shown are the two end pieces 18.

Figure 4:
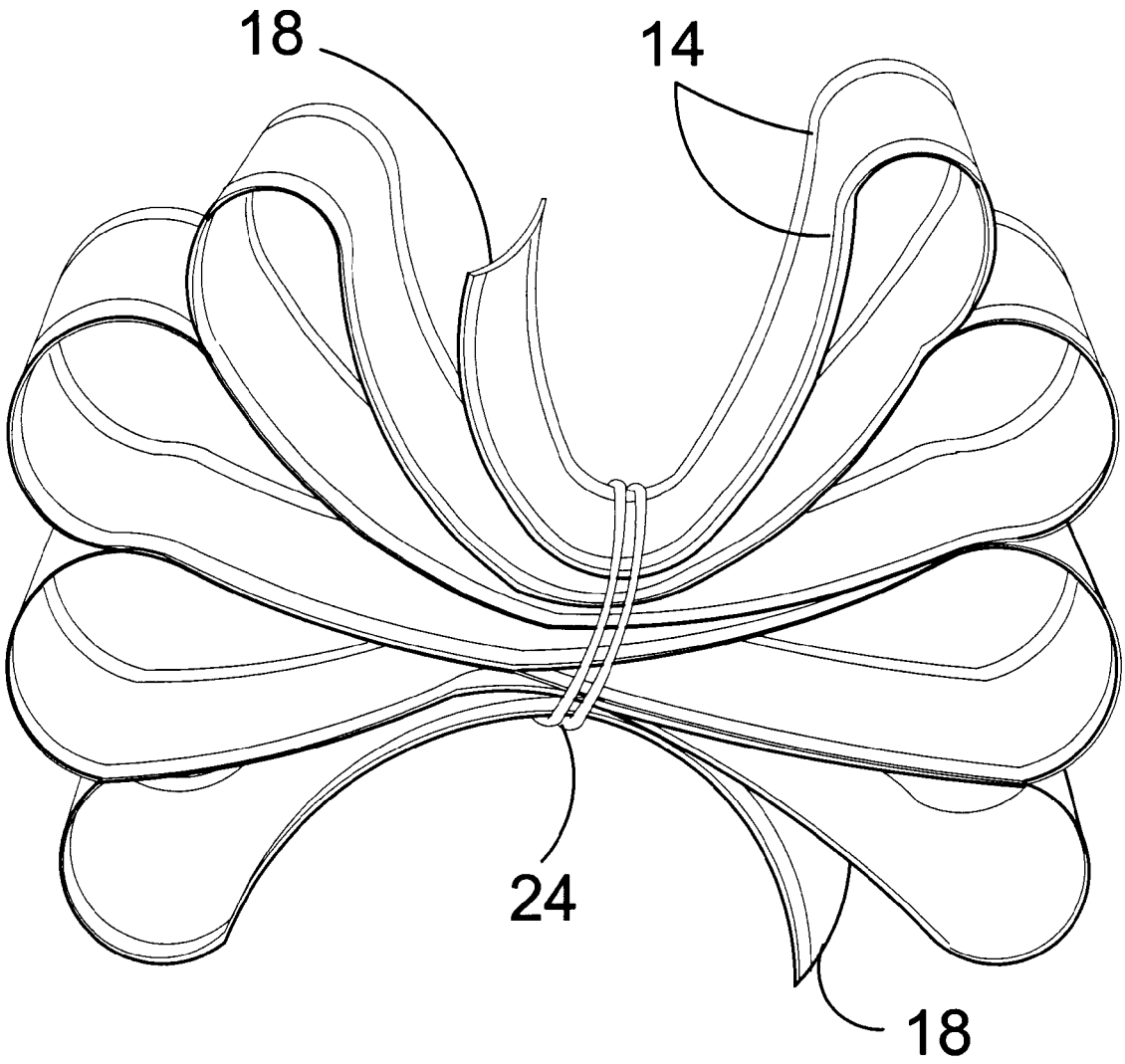
FIG. 4 is step three, a perspective view of the present invention.

Turning to FIG. 4, shown therein is step three, a perspective view of the present invention. In step three of the method of creating the bow of the present invention, a metal wire retainer 24 or the like is used to secure the center of the folded ribbon, thereby forming the bow. Also shown are the single length of wire border ribbon 14 and end pieces 18.

Figure 5:
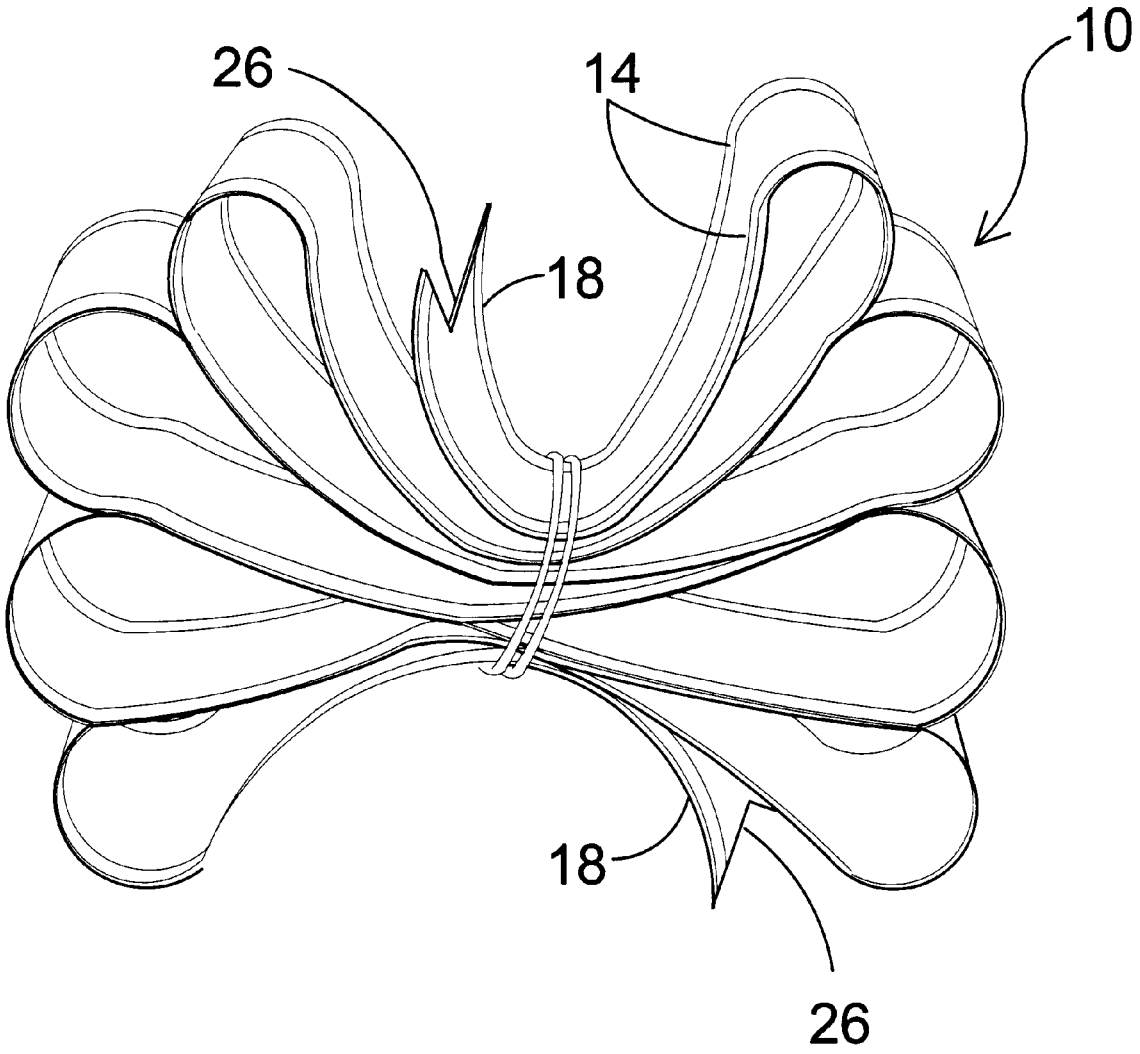
FIG. 5 is step four, a perspective view of the present invention.

Turning to FIG. 5, shown therein is step four, a perspective view of the present invention 10. In step four of the method of creating the bow of the present invention, using a scissor, the distal end pieces 18 of the bow ribbon are cut to form a "V" shaped end 26. The wire border ribbon 14 is also shown.

Figure 6:
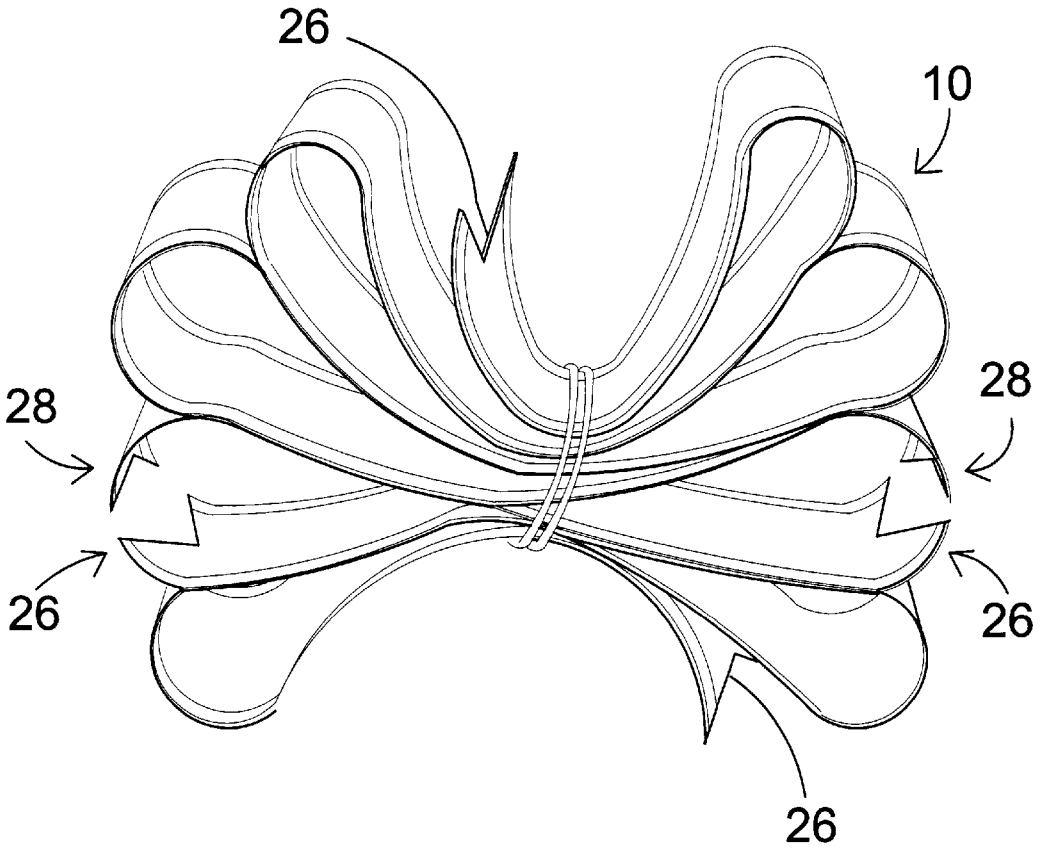
FIG. 6 is step five, a perspective view of the present invention.

Turning to FIG. 6, shown therein is step five, a perspective view of the present invention 10. In step five of the method of creating the bow of the present invention, using a scissor, cut the second loop members 28 from the bottom of the bow to form additional "V" shaped ends 26.

Figure 7:
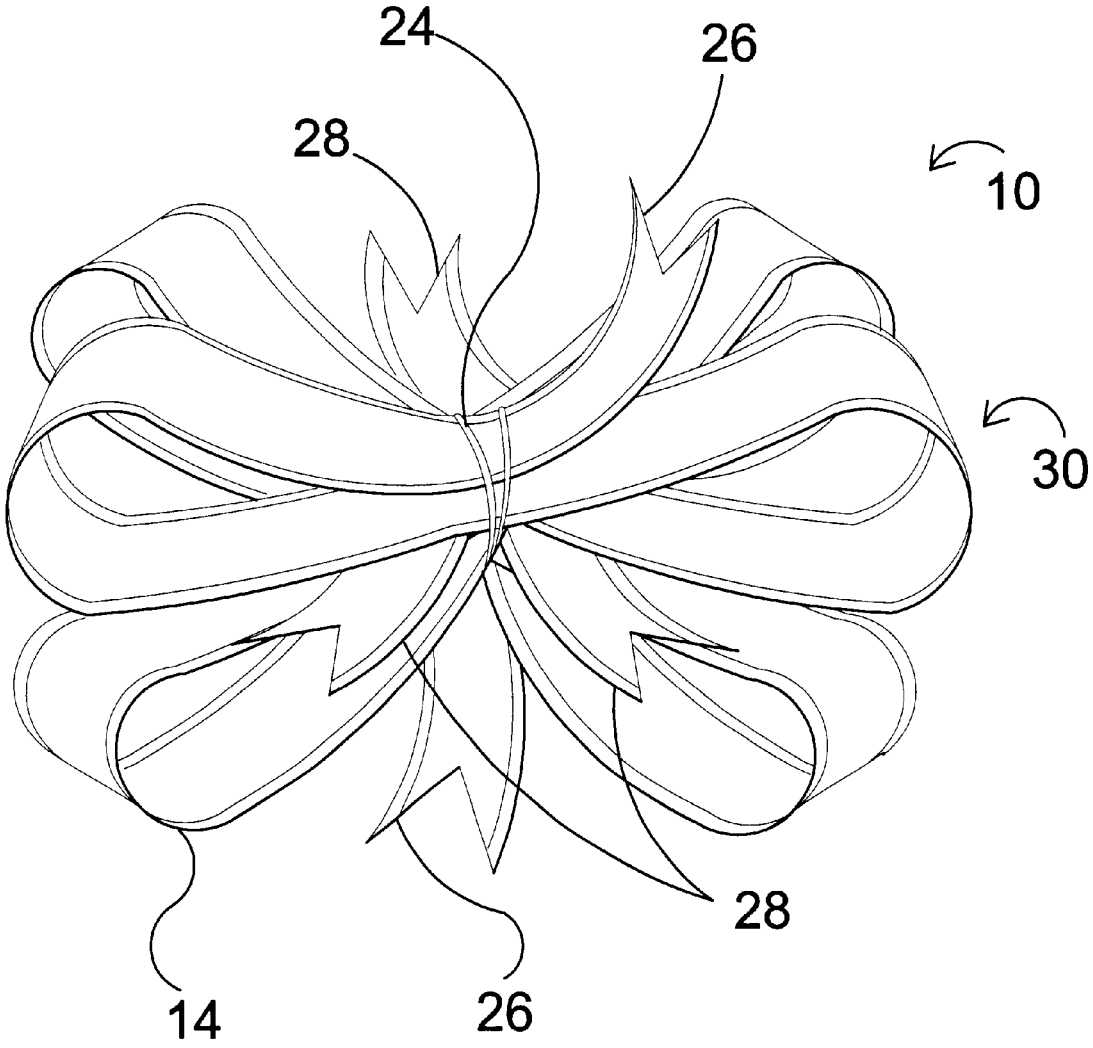
FIG. 7 is step six, a perspective view of the present invention.

Turning to FIG. 7, shown therein is step six, a perspective view of the present invention 10. In step six of the method of creating the bow of the present invention, the loop members are rearranged by rotating the top and bottom of the bow in opposite directions to form a pleasing flower-like 30 design. Other elements previously disclosed are also shown.

Figure 8:
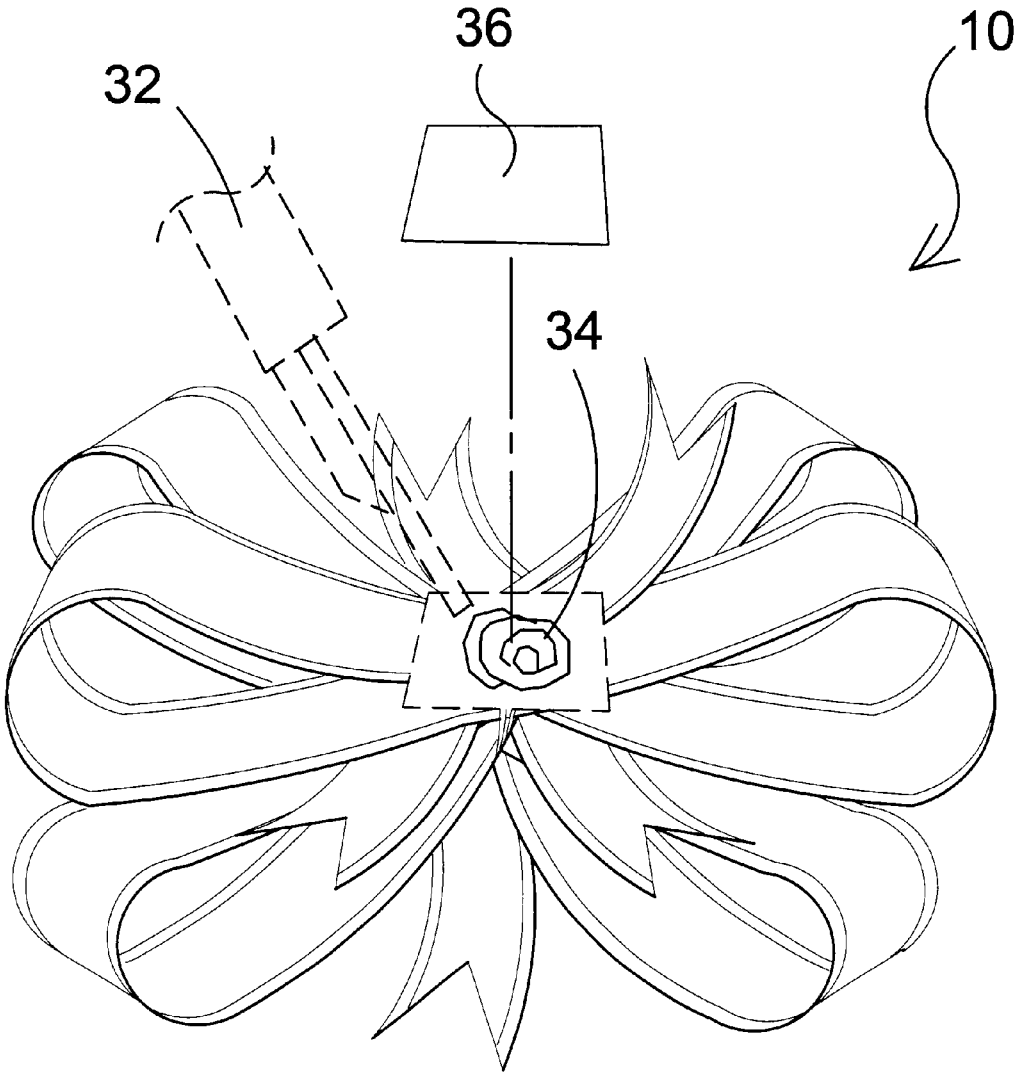
FIG. 8 is step seven, a perspective view of the present invention.

Turning to FIG. 8, shown therein is step seven, a perspective view of the present invention 10. In step seven of the method of creating the bow of the present invention, using a glue gun 32, glue 34 is applied to the center of the bottom portion of the bow. A self-adhesive tag 36 will next be applied in step eight to the glue area.

Figure 9:
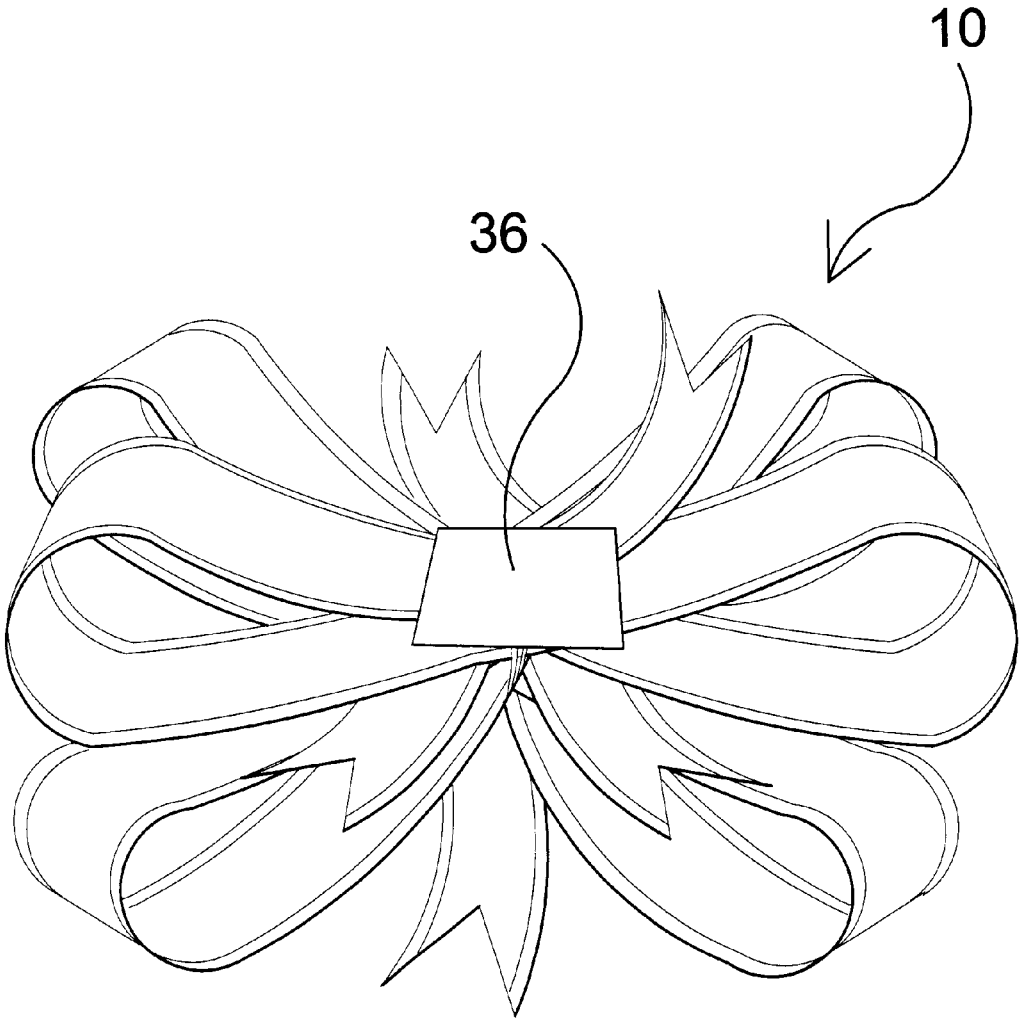
FIG. 9 is step eight, a perspective view of the present invention.

Turning to FIG. 9, shown therein is step eight, a perspective view of the present invention 10. In step eight of the method of creating the bow of the present invention, a self adhering tag 36 is fixedly attached to the bottom portion of the bow. The tag 36 has a peel-off sheet of paper covering an adhesive layered tag.

Figure 10:
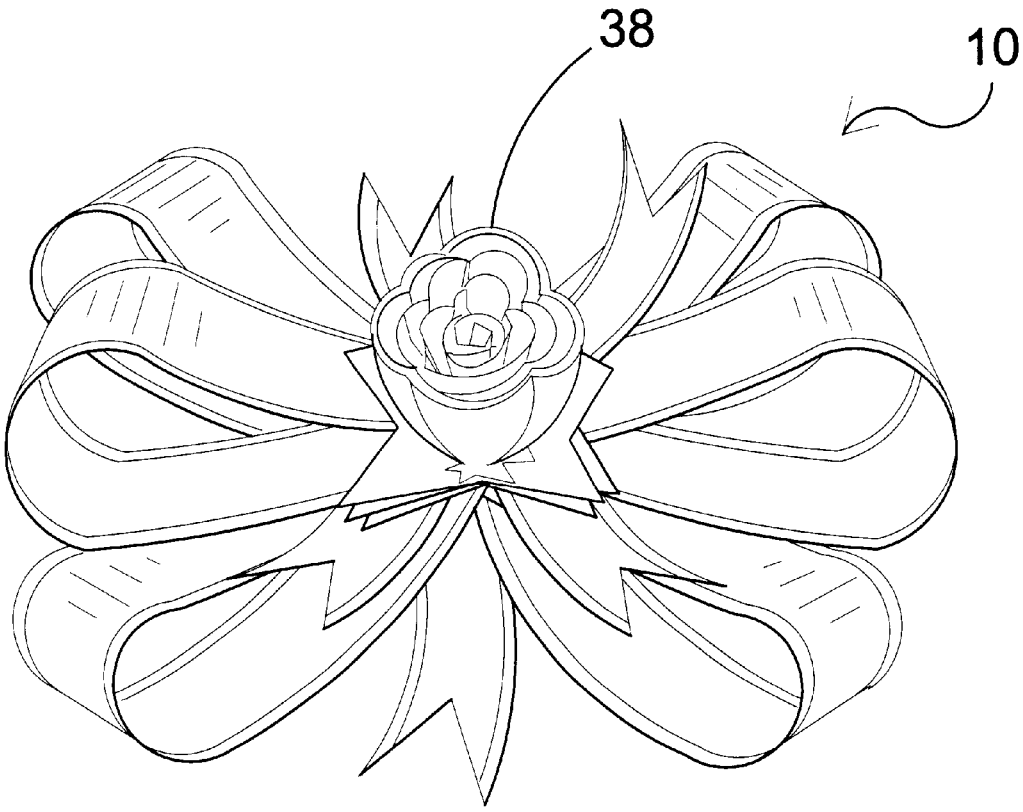
FIG. 10 is step nine, a perspective view of the present invention.

Turning to FIG. 10, shown therein is step nine, a perspective view of the present invention 10. In step nine of the method of creating the bow of the present invention, using a glue gun, the decorative item 38 is placed and glued to the center of the top portion of the bow. The decorative design 38 can be of a variety of items to go with seasonal, holiday or any relevant occasion.

Figure 11:
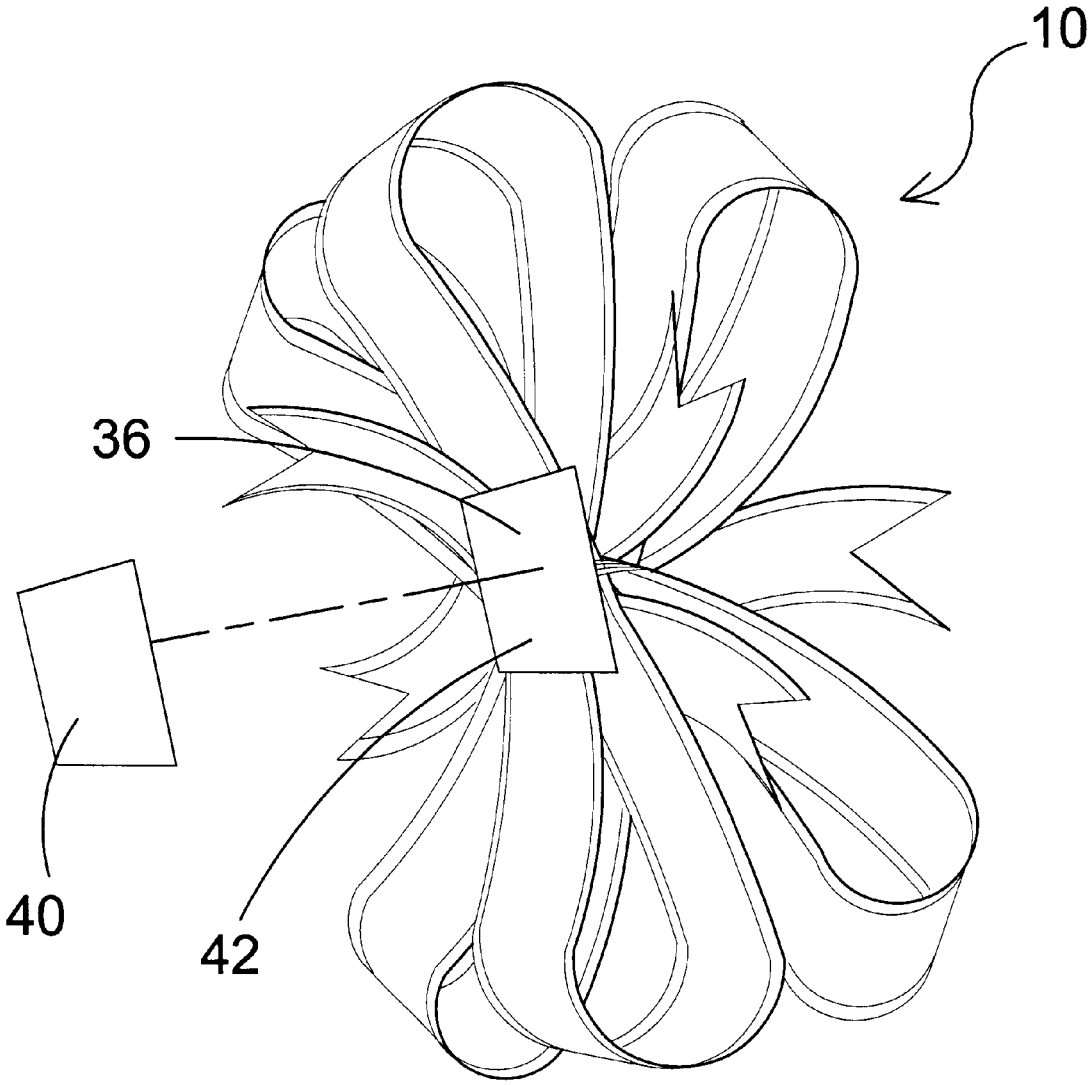
FIG. 11 is a perspective view of the present invention.

Turning to FIG. 11, shown therein is a perspective view of the present invention 10. Shown is a perspective view of the removal of the peel-off cover layer 40 of the self-adhesive tag 36 exposing an adhesive layer 42 for the application of the bow to a package or other surface.

Figure 12:
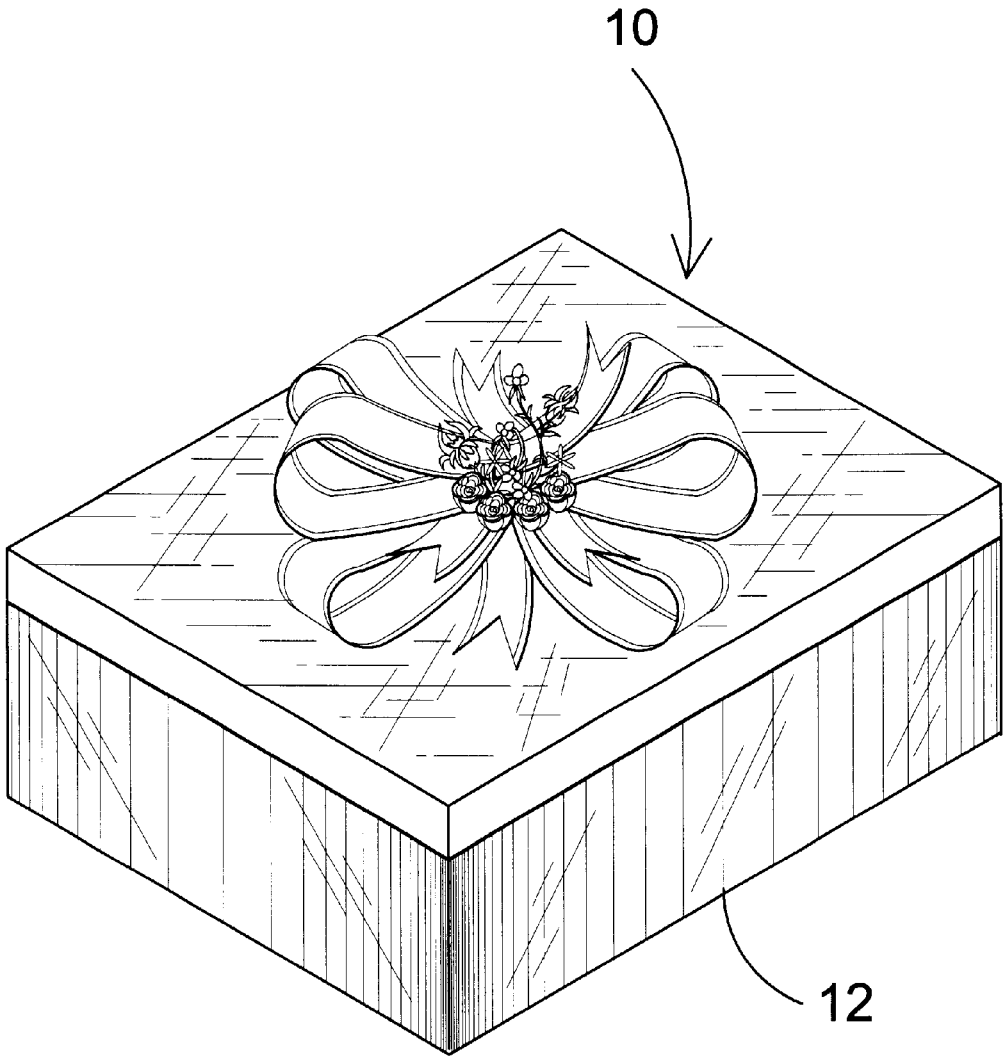
FIG. 12 is a perspective view of the present invention.

Turning to FIG. 12, shown therein is a perspective view of the present invention 10. Shown is a perspective view of an application of the self-adhesive ribbon bow of the present invention 10 to a gift package 12.

What is claimed to be new and desired to be protected by Letters Patent is set forth in the appended claims:

1. A method of forming a decorative, artificial bow using a single unsevered length of ribbon, comprising the steps of:

a) cutting a length of ribbon and folding said length of ribbon to form four loop members on each respective side of the ribbon;

b) joining the four loop members together at their centers;

c) securing the ribbon at the center of the four loop members thereby forming a bow;

d) cutting a V-shaped notch into the opposing ends of the ribbon used to form the bow;

e) cutting the second loop member from the bottom of the bow to form a second "V" shaped notch in each cut end thereof;

f) rearranging the loop members by rotating the top and bottom of the bow in opposite directions to form a flower-like design;

g) attaching a self-adhesive tag to the bottom center of the bow; and, h) attaching a decorative item to the top center of the bow.

2. The method of claim 1, further comprising the step of forming the bow out of wire border ribbon.

3. The method of claim 2, further comprising the step of securing the center of the ribbon using a wire retainer.

4. The method of claim 3, further comprising the step of applying glue to the bottom center of the bow in order to attach the self-adhesive tag.

5. The method of claim 4, further comprising the step of using a glue gun to place glue on the bottom center of the bow in order to attach the self-adhesive tag thereto.

6. The method of claim 5, further comprising the step of providing an adhesive tag having a peel-off cover further comprising an adhesive layer thereon.

7. The method of claim 6, further comprising the step of removing the peel-off cover from the self-adhesive tag and attaching the ribbon to a package by use of the adhesive layer on the self-adhesive tag.

* * * * *